US012385329B2

(12) United States Patent
Yu et al.

(10) Patent No.: US 12,385,329 B2
(45) Date of Patent: Aug. 12, 2025

(54) CONTRACTION JOINT FOR FIBER OPTICS INTELLIGENT COMPLETION

(71) Applicant: Schlumberger Technology Corporation, Sugar Land, TX (US)

(72) Inventors: Leping Yu, Pearland, TX (US); Weichen Lai, Pearland, TX (US); Akhil Bahl, Richmond, TX (US); Jie Zhang, Pearland, TX (US)

(73) Assignee: Schlumberger Technology Corporation, Sugar Land, TX (US)

( * ) Notice: Subject to any disclaimer, the term of this patent is extended or adjusted under 35 U.S.C. 154(b) by 0 days.

(21) Appl. No.: 18/571,307

(22) PCT Filed: Jun. 10, 2022

(86) PCT No.: PCT/US2022/033005
§ 371 (c)(1),
(2) Date: Dec. 18, 2023

(87) PCT Pub. No.: WO2022/271463
PCT Pub. Date: Dec. 29, 2022

(65) Prior Publication Data

US 2024/0287857 A1 Aug. 29, 2024

Related U.S. Application Data

(60) Provisional application No. 63/213,675, filed on Jun. 22, 2021.

(51) Int. Cl.
*E21B 17/07* (2006.01)
*E21B 17/02* (2006.01)
(Continued)

(52) U.S. Cl.
CPC ..... *E21B 17/07* (2013.01); *E21B 17/023* (2013.01); *E21B 17/043* (2013.01); *E21B 23/00* (2013.01); *E21B 17/04* (2013.01)

(58) Field of Classification Search
CPC ..... E21B 17/07; E21B 17/023; E21B 17/043; E21B 17/04; E21B 23/00
See application file for complete search history.

(56) References Cited

U.S. PATENT DOCUMENTS 1,844,257 A 2/1932 Lincoln
2,886,289 A 5/1959 Le Bus, Sr.
(Continued)

FOREIGN PATENT DOCUMENTS

AU 2014413985 B2 6/2016
WO 2009042310 A1 4/2009
(Continued)

OTHER PUBLICATIONS

International Search Report and Written Opinion issued in the PCT Application PCT/US2022/022999 (IS21.3061-WO-PCT), dated Jul. 14, 2022 (9 pages).
(Continued)

*Primary Examiner* — Nicole Coy
*Assistant Examiner* — Jennifer A Railey
(74) *Attorney, Agent, or Firm* — Jeffrey D. Frantz

(57) ABSTRACT

A contraction joint includes an upper tubular member, an upper mandrel, a lower mandrel, a nipple housing connected to the upper tubular member, a support sleeve disposed around the upper mandrel, an activation dog disposed within the support sleeve, a lock housing disposed in an annular space between the nipple housing and the mandrel, the lock housing connecting the upper mandrel to the lower mandrel, and a stroke locking mechanism disposed within the lock housing. In the locked position, the lock housing is affixed to the support sleeve with a shear mechanism, the stroke locking mechanism is supported by the support sleeve, and
(Continued)

a stroke locking mechanism profile and an activation profile of the activation dog prevent the nipple housing from moving.

20 Claims, 3 Drawing Sheets

(51) Int. Cl.

| | |
|---|---|
| ***E21B 17/043*** | (2006.01) |
| ***E21B 23/00*** | (2006.01) |
| *E21B 17/04* | (2006.01) |

(56) References Cited

U.S. PATENT DOCUMENTS

| | | | | |
|---|---|---|---|---|
| 3,356,145 | A | 12/1967 | Fredd | |
| 5,103,902 | A | 4/1992 | Ross | |
| 5,538,082 | A * | 7/1996 | Zwart | E21B 23/02 166/123 |
| 6,367,552 | B1 | 4/2002 | Scott | |
| 6,540,025 | B2 | 4/2003 | Scott | |
| 7,216,713 | B2 * | 5/2007 | Read, Jr. | E21B 23/006 166/321 |
| 7,503,395 | B2 | 3/2009 | Meijer et al. | |
| 7,806,190 | B2 | 10/2010 | Du | |
| 8,061,430 | B2 | 11/2011 | Du | |
| 9,371,703 | B2 | 6/2016 | Roane | |
| 10,301,888 | B2 | 5/2019 | Richards | |
| 10,422,191 | B2 | 9/2019 | Richards | |
| 2010/0224360 | A1 | 9/2010 | MacDougall | |
| 2010/0224375 | A1 | 9/2010 | Du | |
| 2013/0199799 | A1 | 8/2013 | Phan | |
| 2016/0069145 | A1 | 3/2016 | McGuire | |
| 2016/0153248 | A1 * | 6/2016 | Richards | E21B 17/06 166/335 |
| 2016/0290062 | A1 | 10/2016 | Richards | |
| 2017/0183918 | A1 | 6/2017 | Grattan | |
| 2017/0183919 | A1 * | 6/2017 | Cochran | E21B 17/07 |
| 2024/0183229 | A1 * | 6/2024 | Lai | E21B 17/07 |

FOREIGN PATENT DOCUMENTS

| | | | |
|---|---|---|---|
| WO | 2010078111 | A2 | 7/2010 |
| WO | 2019067307 | A1 | 4/2019 |
| WO | 2022212810 | A1 | 10/2022 |

OTHER PUBLICATIONS

International Search Report and Written Opinion issued in the PCT Application PCT/US2022/033005 (IS21.3548-WO-PCT), dated Sep. 22, 2022 (9 pages).

* cited by examiner

CONTRACTION JOINT FOR FIBER OPTICS INTELLIGENT COMPLETION

CROSS-REFERENCE TO RELATED APPLICATIONS

This application is a National Stage Entry of International Application No. PCT/US2022/033005, filed Jun. 10, 2022, which claims the benefit of U.S. Provisional Application No. 63/213,675, entitled "Contraction Joint for Fiber Optics Intelligent Completion," filed Jun. 22, 2021, the disclosure of which is incorporated herein by reference in its entirety.

BACKGROUND

In many well related operations, contraction joints are used with well completions, such as between two or more completion assemblies, to compensate for contraction and expansion of the completion string. Wellbore completions typically utilize one or more control lines to carry signals between components within the wellbore and/or the surface. It can be difficult to control or maintain the integrity of those control lines at a contraction joint because axial movement of the contraction joint can cause the lines to knot or tangle as the contraction joint expands or contracts. Moreover, it may be difficult to control the functionality of the contraction joint until the contraction joint reaches a desired depth downhole and to accommodate production operations at depth through the contraction joint. There is a need, therefore, for a contraction joint that can accommodate control lines, and that remains locked until a desired depth downhole is reached to facilitate production operations.

SUMMARY

According to one or more embodiments of the present disclosure, a contraction joint includes an upper tubular member; a mandrel including an upper mandrel including a recess; and a lower mandrel, wherein the upper tubular member is capable of moving uphole and downhole to change a length of the contraction joint, a nipple housing connected to the upper tubular member, a support sleeve disposed around the upper mandrel, an activation dog disposed within the support sleeve, the activation dog including an activation profile; a lock housing disposed in an annular space between the nipple housing and the mandrel, the lock housing connecting the upper mandrel to the lower mandrel; and a stroke locking mechanism disposed within the lock housing, the stroke locking mechanism including a profile that engages the nipple housing, wherein in a locked position, the lock housing is affixed to the support sleeve with a shear mechanism, the storke locking mechanism is supported by the support sleeve, and the stroke locking mechanism profile and the activation profile prevent the nipple housing from moving.

However, many modifications are possible without materially departing from the teachings of this disclosure. Accordingly, such modifications are intended to be included within the scope of this disclosure as defined in the claims.

BRIEF DESCRIPTION OF THE DRAWINGS

Certain embodiments of the disclosure will hereafter be described with reference to the accompanying drawings, wherein like reference numerals denote like elements. It should be understood, however, that the accompanying figures illustrate the various implementations described herein and are not meant to limit the scope of various technologies described herein, and.

DETAILED DESCRIPTION

In the following description, numerous details are set forth to provide an understanding of some embodiments of the present disclosure. However, it will be understood by those of ordinary skill in the art that the system and/or methodology may be practiced without these details and that numerous variations or modifications from the described embodiments may be possible.

In the specification and appended claims, the terms "connect," "connection," "connected," "in connection with," and "connecting," are used to mean "in direct connection with," in connection with via one or more elements." The terms "couple," "coupled," "coupled with," "coupled together," and "coupling" are used to mean "directly coupled together," or "coupled together via one or more elements." The term "set" is used to mean setting "one element" or "more than one element." As used herein, the terms "up" and "down," "upper" and "lower," "upwardly" and "downwardly," "upstream" and "downstream," "uphole" and "downhole," "above" and "below," "top" and "bottom," and other like terms indicating relative positions above or below a given point or element are used in this description to more clearly describe some embodiments of the disclosure. Commonly, these terms relate to a reference point at the surface from which drilling operations are initiated as being the top point and the total depth being the lowest point, wherein the well (e.g., wellbore, borehole) is vertical, horizontal, or slanted relative to the surface.

The present disclosure generally relates to a system and methodology that facilitates the use of a contraction joint in a well completion application. Specifically, the present disclosure relates to a contraction joint that includes a stroke locking mechanism that allows the contraction joint to remain locked when running in hole, and allows the contraction joint to achieve contraction functionality at depth downhole. Advantageously, the contraction joint according to one or more embodiments of the present disclosure accommodates one or more control lines and facilitates production operations at depth when in the unlocked position. Moreover, the contraction joint according to one or more embodiments of the present disclosure eliminates the possibility of being inadvertently activated via compression. That is, the contraction joint according to one or more embodiments of the present disclosure can only be activated via tension. The contraction joint according to one or more embodiments of the present disclosure is related to the contraction joint described in U.S. Provisional Patent Application No. 63/170,090 filed on Apr. 2, 2021, which is incorporated herein by reference in its entirety.

Figure 1:
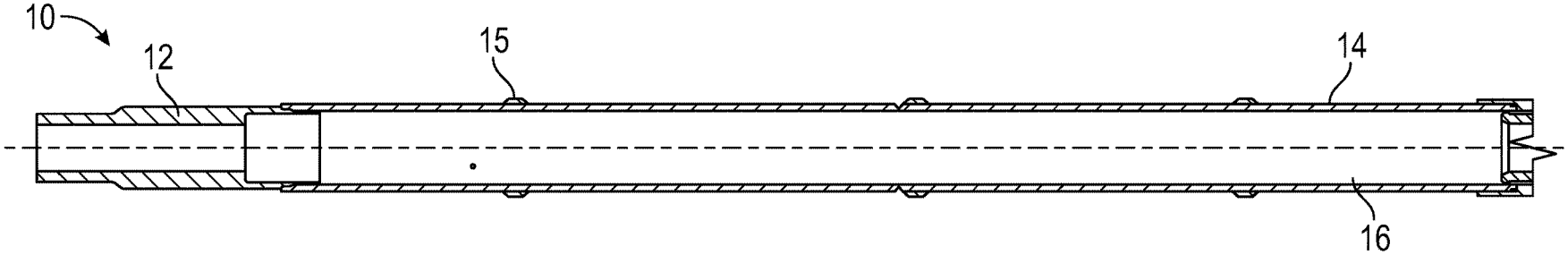
FIG. 1 shows a top section of a contraction joint according to one or more embodiments of the present disclosure.
Figure 2:
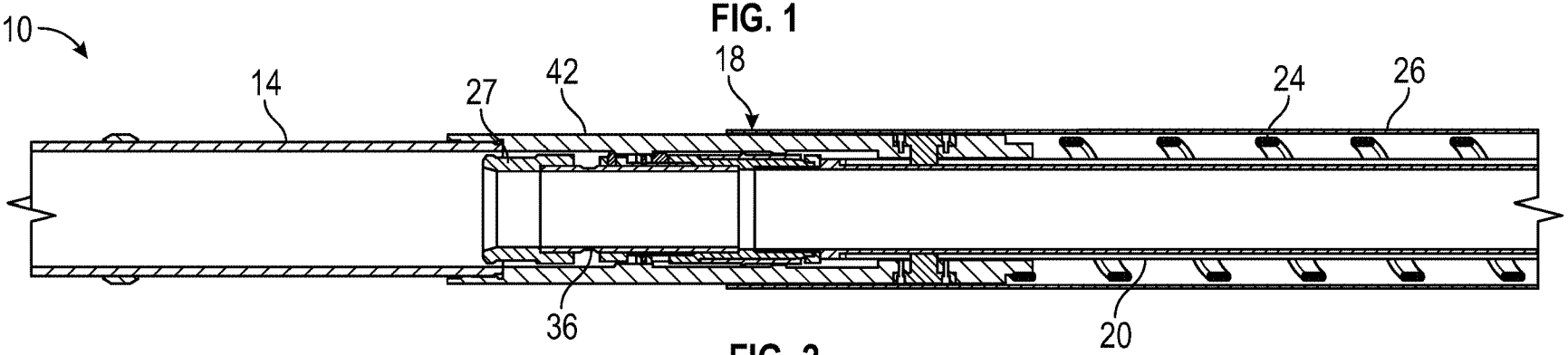
FIG. 2 shows a middle section of a contraction joint according to one or more embodiments of the present disclosure.
Figure 3:
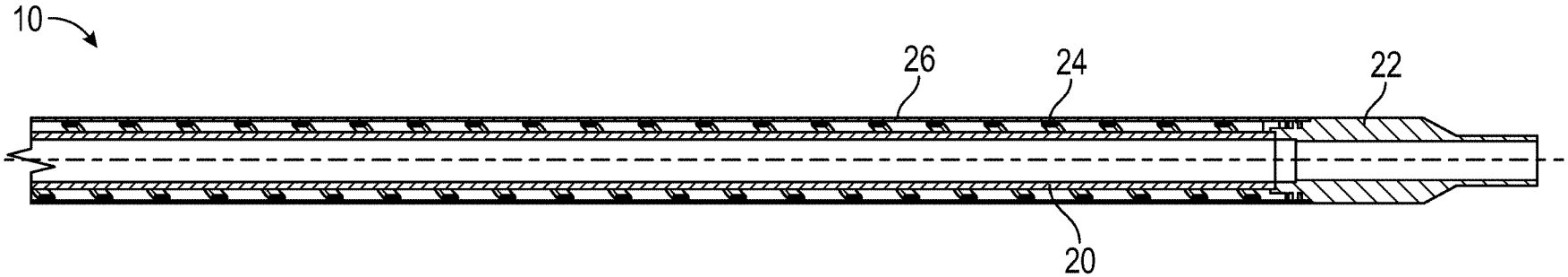
FIG. 3 shows a bottom section of a contraction joint according to one or more embodiments of the present disclosure.

Referring now to FIGS. 1-3, a contraction joint 10 according to one or more embodiments of the present disclosure is shown. Specifically, FIG. 1 shows a top section of the contraction joint 10, FIG. 2 shows a middle section of the contraction joint 10, and FIG. 3 shows a bottom section of the contraction joint 10. In one or more embodiments of the present disclosure, the contraction joint 10 may be a component of a well completion system having an upper completion and a lower completion (not shown), for example. As shown in FIG. 1, the top section of the contraction joint 10 may include a top sub 12 connected to an upper tubular member 14, according to one or more embodiments of the present disclosure. As also shown in FIG. 1, the upper tubular member 14 has a bore 16 therethrough, according to one or more embodiments of the present disclosure. The upper tubular member 14 is capable of moving uphole and downhole to change a length of the contraction joint 10 according to one or more embodiments of the present disclosure.

As shown in FIG. 2, the middle section of the contraction joint 10 may include a mandrel 18 including an upper mandrel 36 and a lower mandrel 20. As more clearly shown in FIG. 4, for example, the upper mandrel 36 of the mandrel 18 may include a recess 37. Moreover, the contraction joint 10 may include an anti-rotation mechanism 34, as shown in FIG. 2, for example, to prevent rotation of the upper tubular member 14 and the mandrel 18 relative to one another, while allowing telescoping movement of the upper tubular member 14 and the mandrel 18 relative to one another. As further shown in FIG. 2, the contraction joint 10 may include an end cap 27 disposed at an upper end of the upper mandrel 36, according to one or more embodiments of the present disclosure. FIG. 2 also shows that the contraction joint 10 may include a nipple housing 42 connected to the upper tubular member 14 according to one or more embodiments of the present disclosure. In one or more embodiments of the present disclosure, the anti-rotation mechanism 34 may be disposed within the nipple housing 42 and affixed to the lower mandrel 20, as shown in FIG. 2, for example. As further shown in FIG. 2, the contraction joint 10 according to one or more embodiments of the present disclosure may also include at least one cable 24 coiled around at least a portion of the lower mandrel 20. In one or more embodiments of the present disclosure, the contraction joint 10 may also include a cable shroud 26 disposed around the lower mandrel 20 to protect the at least one cable 24.

As shown in FIG. 3, the bottom section of the contraction joint 10 may include a bottom sub 22 connected to the lower mandrel 20. According to one or more embodiments of the present disclosure, the upper completion of the well completion system may be connected to the contraction joint 10 via the top sub 12, and the lower completion of the well completion system may be connected to the contraction joint 10 via the bottom sub 22.

In view of FIGS. 2 and 3, the contraction joint 10 according to one or more embodiments of the present disclosure may accommodate at least one cable 24 coiled around at least a portion of the lower mandrel 20. According to one or more embodiments of the present disclosure, the at least one cable 24 may be a control line, such as an optical, electrical, and/or hydraulic control line to carry signals between components within the wellbore and/or the surface. According to one or more embodiments of the present disclosure, the top section of the contraction joint 10, as shown in FIG. 1, may include a plurality of bypass rings 15 to facilitate intelligent completion cable bypass, for example. Referring back to FIGS. 2 and 3, the contraction joint 10 according to one or more embodiments of the present disclosure may include a cable shroud 26 disposed around the lower mandrel 20 to protect the at least one cable 24. The contraction joint 10 according to one or more embodiments of the present disclosure may also include at least one transition component (not shown) affixed to the lower mandrel 20. According to one or more embodiments of the present disclosure, the transition component is configured to allow the at least one cable 24 to transition from a coiled configuration to a straight configuration for running uphole.

Figure 4:
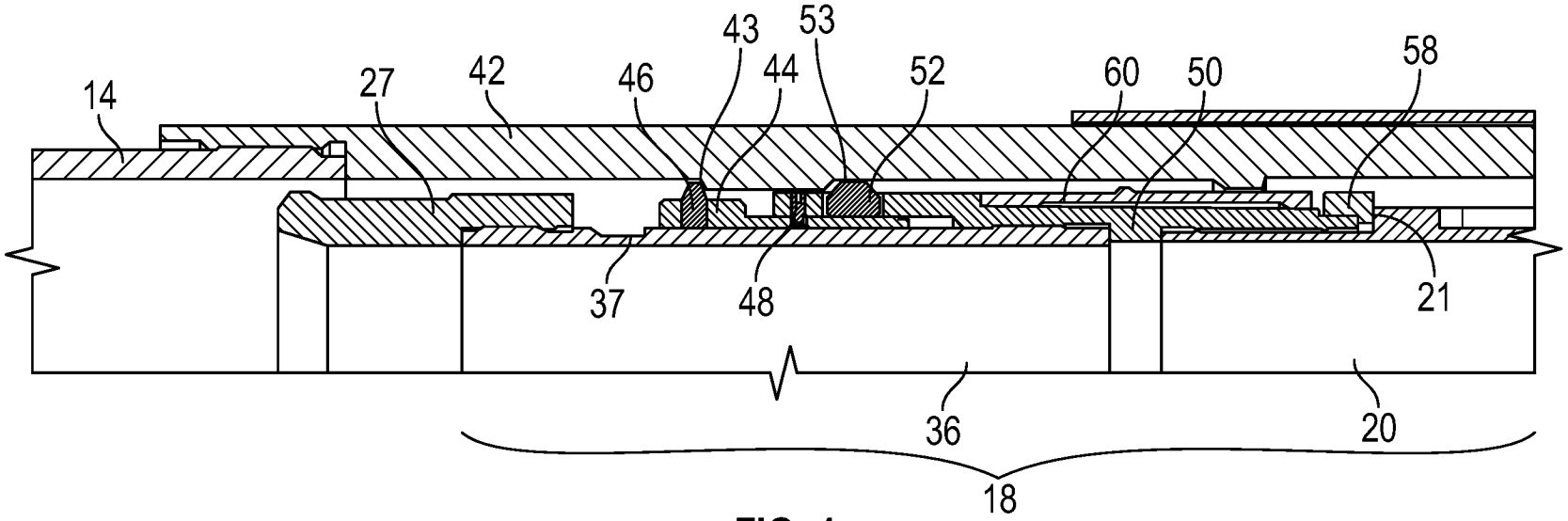
FIG. 4 shows a detailed cross-sectional view of a portion of the middle section of the contraction joint with a stroke locking mechanism in a locked position and before activation, according to one or more embodiments of the present disclosure.

Referring now to FIG. 4, a detailed cross-sectional view of a portion of the middle section of the contraction joint 10 is shown before activation of the contraction joint 10. Specifically, FIG. 4 provides a more detailed view of the components that make up the middle section of the contraction joint 10, as shown in FIG. 2, for example. According to one or more embodiments of the present disclosure, the contraction joint 10 includes a nipple housing 42 connected to the upper tubular member 14. According to one or more embodiments of the present disclosure, the contraction joint 10 also includes a support sleeve 44 disposed around the upper mandrel 36, and an activation dog 46 disposed within the support sleeve 44. According to one or more embodiments of the present disclosure, the activation dog 46 includes an activation profile 43 that is configured to engage with the nipple housing 42 before activation of the contraction joint 10.

Still referring to FIG. 4, the contraction joint 10 according to one or more embodiments of the present disclosure may also include a lock housing (or dog housing) 50 disposed in an annular space between the nipple housing 42 and the mandrel 18. In one or more embodiments of the present disclosure, the lock housing 50 connects the upper mandrel 36 to the lower mandrel 20, for example. The contraction joint 10 according to one or more embodiments of the present disclosure also includes a tension shoulder 58 disposed between an end of the lock housing 50 and a stop 21 of the lower mandrel 20. According to one or more embodiments of the present disclosure, the contraction joint 10 also includes a collet 60 disposed in the annular space between the nipple housing 42 and the lock housing 50. The contraction joint 10 also includes a stroke locking mechanism (or compression dog) 52 disposed within the lock housing 50, according to one or more embodiments of the present disclosure. The stroke locking mechanism 52 includes a profile 53 that engages the nipple housing 42 in one or more embodiments of the present disclosure. FIG. 4 shows the stroke locking mechanism 52 in the locked position, which is the position that the stroke locking mechanism 52 assumes when the contraction joint 10 is run-in-hole, for example. Specifically, FIG. 4 shows that the stroke locking mechanism 52 is supported by the support sleeve 44, and the stroke locking mechanism profile 53 and the activation profile 43 prevent the nipple housing 42 from moving. According to one or more embodiments of the present disclosure, before activation, the contraction joint 10 is in a locked position, and the lock housing 50 is affixed to the support sleeve 44 with a shear mechanism 48. According to one or more embodiments of the present disclosure, the shear mechanism 48 may be a shear pin or a shear screw, for example. When the contraction joint 10 is in the locked position, when tension is applied through the upper tubular member 14, the tension transfers to the nipple housing 42, to the activation dog 46, to the support sleeve 44, to the shear mechanism 48, to the lock housing 50, to the tension shoulder, to the lower mandrel 20, and to the lower completion, according to one or more embodiments of the present disclosure. The source of this tension may be from one or more components of the lower completion downhole of the contraction joint 10, for example. Moreover, when the contraction joint 10 is in the locked position, when compression is applied through the upper tubular member 14, the compression transfers to the nipple housing 42, to the stroke locking mechanism 52, to the lock housing 50, to the tension shoulder, to the lower mandrel 20, and to the lower completion, according to one or more embodiments of the present disclosure. The source of this compression may be from one or more components of the lower completion downhole of the contraction joint 10, for example.

Figure 5:
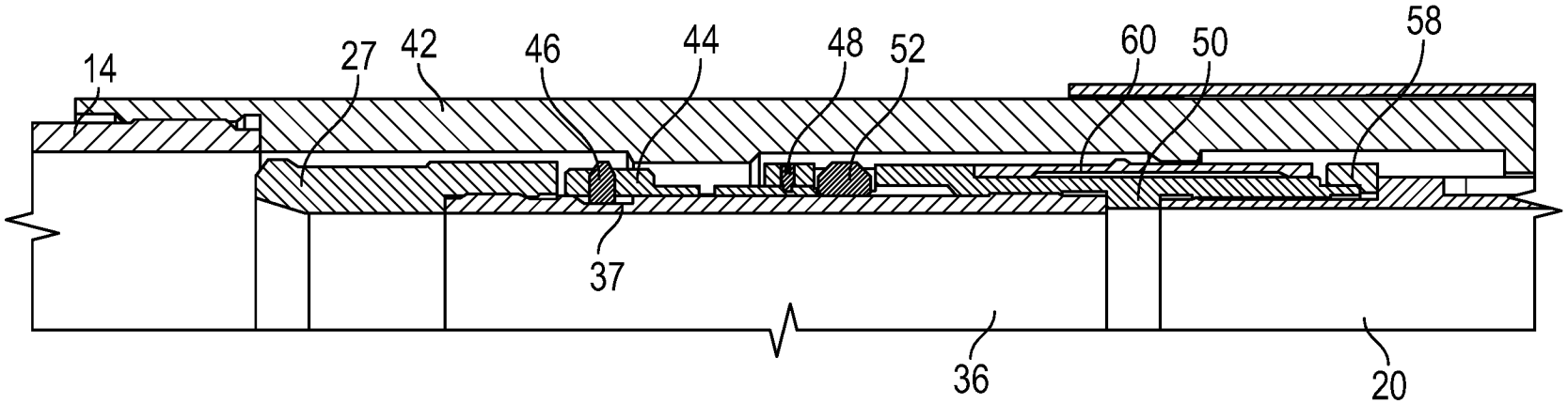
FIG. 5 shows a detailed cross-sectional view of a portion of the middle section of the contraction joint with the stroke locking mechanism in an unlocked position after activation, according to one or more embodiments of the present disclosure.

Referring now to FIG. 5, the stroke locking mechanism 52 of the contraction joint 10 unlocked or activated at depth, according to one or more embodiments of the present disclosure. In operation, when sufficient tension is applied through the upper tubular member 14, the tension shears the shear mechanism 48 and shifts the support sleeve 44 and the activation dog 46 uphole, causing the activation dog 46 to drop into the recess 37 of the upper mandrel 36, and the stroke locking mechanism 52 to drop from the support sleeve 44 into an unlocked position and break the compression load path. Thereafter, application of a compression force to the upper tubular member 14 pushes the upper tubular member 14 and the nipple housing 42 downhole to achieve contraction functionality of the contraction joint 10, according to one or more embodiments of the present disclosure.

In operation, a well completion including the contraction joint 10 according to one or more embodiments of the present disclosure may be run-in-hole to a downhole location while the stroke locking mechanism 52 of the contraction joint 10 is in the locked position. As previously described, tension may be applied through the upper tubular member 14 until the shear mechanism 48 shears, allowing the support sleeve 44 and the activation dog 46 to shift uphole, causing the activation dog to drop into the recess of the upper mandrel 36, and the stroke locking mechanism 52 to drop from the support sleeve 44 into an unlocked position. Thereafter, a compression force may be applied to the upper tubular member 14 to push the upper tubular member 14 and the nipple housing 42 downhole to achieve contraction functionality of the contraction joint 10. In one or more embodiments of the present disclosure, a production operation may be initiated after the upper tubular member 14 and the nipple housing 42 of the contraction joint 10 are pushed downhole. According to one or more embodiments of the present disclosure, during the production operation, production fluid flows uphole through the mandrel 18 and into the bore 16 of the upper tubular member 14 to a surface location. According to one or more embodiments of the present disclosure, during the production operation, the contraction joint 10 is non-sealing.

Figure 6:
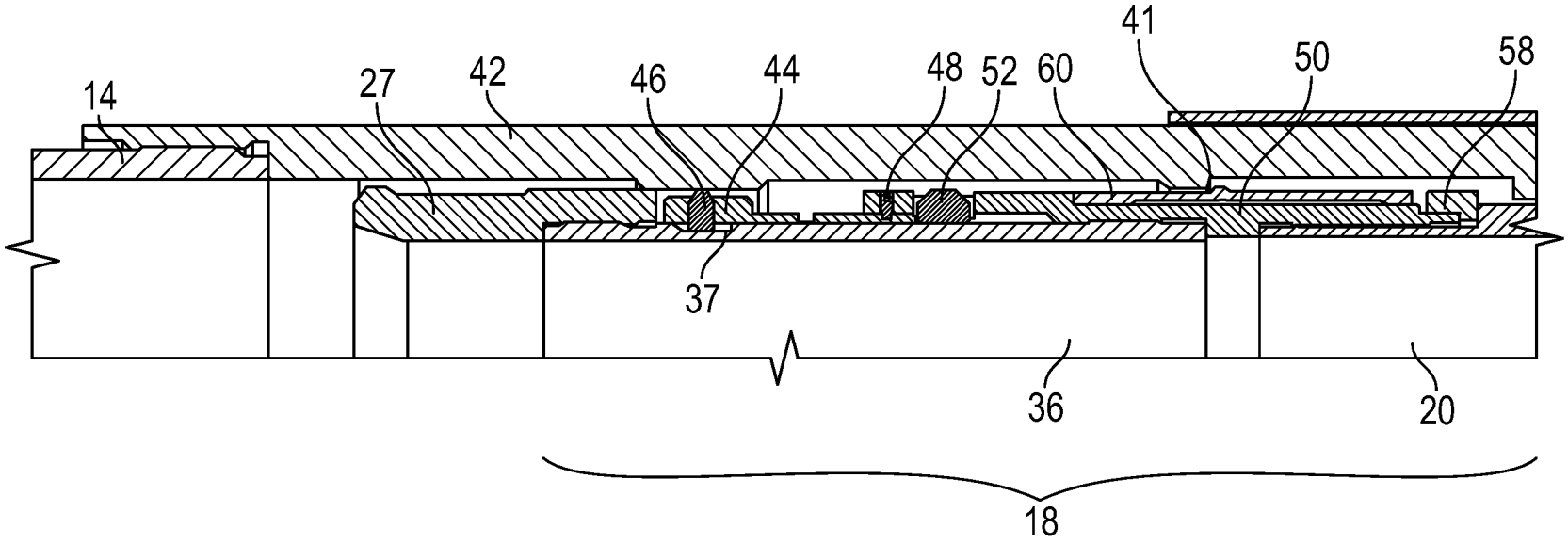
FIG. 6 shows a detailed cross-sectional view of a portion of the middle section of the contraction joint in a resettable locked position, according to one or more embodiments of the present disclosure.

Referring now to FIG. 6, a resettable locked position of the contraction joint 10 according to one or more embodiments of the present disclosure is shown. That is, in a method according to one or more embodiments of the present disclosure, the contraction joint 10 may be repeatedly reset to the locked position after being previously unlocked. For example, to reset the contraction joint 10 and axially lock the movement again, tension may be applied through the upper tubular member 14 and nipple housing 42 to a locked position through collet 60. To space out again to land the tubing hanger, compression may be applied to the upper tubular member 14 to move the nipple housing 42 profile 41 to the lower side of the collet 60 to initiate the stroking motion. According to one or more embodiments of the present disclosure, the reset of the contraction joint 10 may be repeated multiple times.

Although a few embodiments of the disclosure have been described in detail above, those of ordinary skill in the art will readily appreciate that many modifications are possible without materially departing from the teachings of this disclosure. Accordingly, such modifications are intended to be included within the scope of this disclosure as defined in the claims.

What is claimed is:

1. A contraction joint, comprising:

an upper tubular member;

a mandrel comprising: an upper mandrel comprising a recess; and a lower mandrel, wherein the upper tubular member is capable of moving uphole and downhole to change a length of the contraction joint;

a nipple housing connected to the upper tubular member;

a support sleeve disposed around the upper mandrel;

an activation dog disposed within the support sleeve, the activation dog comprising an activation profile;

a lock housing disposed in an annular space between the nipple housing and the mandrel, the lock housing connecting the upper mandrel to the lower mandrel; and a stroke locking mechanism disposed within the lock housing, the stroke locking mechanism comprising a stroke locking mechanism profile that engages the nipple housing, wherein, in a locked position, the lock housing is affixed to the support sleeve with a shear mechanism, the stroke locking mechanism is supported by the support sleeve, and the stroke locking mechanism profile and the activation profile prevent the nipple housing from moving.

2. The contraction joint of claim 1, wherein application of tension through the upper tubular member shears the shear mechanism and shifts the support sleeve and the activation dog uphole, causing the activation dog to drop into the recess of the upper mandrel, and the stroke locking mechanism to drop from the support sleeve into an unlocked position, wherein application of a compression force to the upper tubular member pushes the upper tubular member and the nipple housing downhole to achieve contraction functionality of the contraction joint.

3. The contraction joint of claim 1, further comprising an anti-rotation mechanism disposed in the nipple housing and affixed to the lower mandrel.

4. The contraction joint of claim 1, further comprising at least one cable coiled around at least a portion of the lower mandrel.

5. The contraction joint of claim 4, further comprising a cable shroud disposed around the lower mandrel to protect the at least one cable.

6. The contraction joint of claim 1, further comprising an end cap disposed at an upper end of the upper mandrel.

7. The contraction joint of claim 1, further comprising a tension shoulder disposed between an end of the lock housing and a stop of the lower mandrel.

8. The contraction joint of claim 1, further comprising a collet disposed in the annular space between the nipple housing and the lock housing.

9. A system, comprising:

an upper completion;

a lower completion; and the contraction joint of claim 1, wherein the contraction joint further comprises: a top sub connected to the upper tubular member; and a bottom sub connected to the lower mandrel, wherein the upper completion is connected to the top sub, and wherein the lower completion is connected to the bottom sub.

10. A method, comprising:

running a well completion comprising the contraction joint of claim 1 to a downhole location, wherein the stroke locking mechanism of the contraction joint is in the locked position during the running step;

applying tension through the upper tubular member, shearing the shear mechanism;

shifting the support sleeve and the activation dog uphole, causing the activation dog to drop into the recess of the upper mandrel, and the stroke locking mechanism to drop from the support sleeve into an unlocked position, applying a compression force to the upper tubular member to push the upper tubular member and the nipple housing downhole to achieve contraction functionality of the contraction joint.

11. The method of claim 10, further comprising:

initiating a production operation after the applying the compression force step, wherein, during the production operation, production fluid flows uphole through the mandrel and into a bore of the upper tubular member to a surface location.

12. The method of claim 10, the contraction joint further comprising an anti-rotation mechanism.

13. The method of claim 10, the contraction joint further comprising at least one cable coiled around at least a portion of the lower mandrel.

14. The method of claim 13, the contraction joint further comprising a cable shroud disposed around the lower mandrel to protect the at least one cable.

15. The method of claim 10, the contraction joint further comprising an end cap disposed at an upper end of the upper mandrel.

16. The method of claim 10, the contraction joint further comprising a tension shoulder disposed between an end of the lock housing and a stop of the lower mandrel.

17. The method of claim 10, the contraction joint further comprising a collet disposed in the annular space between the nipple housing and the lock housing.

18. The method of claim 17, further comprising:

resetting the contraction joint by:

applying tension through the upper tubular member and the nipple housing to achieve a locked position through the collet; and applying compression to the upper tubular member to move a profile of the nipple housing to a lower side of the collet to initiate a stroking motion.

19. The method of claim 18, further comprising repeating the resetting step.

20. The method of claim 10, wherein the well completion further comprises: an upper completion; and a lower completion, wherein the contraction joint further comprises: a top sub connected to the upper tubular member; and a bottom sub connected to the lower mandrel, wherein the upper completion is connected to the top sub, and wherein the lower completion is connected to the bottom sub.

* * * * *